United States Patent [19]

Bishop et al.

[11] 4,161,274

[45] Jul. 17, 1979

[54] DOOR PANEL FOR MAIL BOX UNIT

[75] Inventors: Allan T. Bishop, Senneville; Maurice Wytruk, La Salle, both of Canada

[73] Assignee: Accessories Manufacturers, Ltd., Montreal, Canada

[21] Appl. No.: 867,460

[22] Filed: Jan. 6, 1978

[30] Foreign Application Priority Data

Oct. 24, 1977 [CA] Canada ..... 289377

[51] Int. Cl.[2] ..... B65D 91/00; F16B 12/00

[52] U.S. Cl. ..... 232/24; 52/666; 232/25

[58] Field of Search ..... 232/24, 25; 312/257 R; 52/668, 666

[56] References Cited

U.S. PATENT DOCUMENTS

| | | | |
|---|---|---|---|
| 449,936 | 4/1891 | Jackson | 232/24 |
| 491,495 | 2/1893 | Ridell | 232/24 |
| 1,642,533 | 9/1927 | Beer | 232/25 |
| 2,047,454 | 7/1936 | Anderson et al. | 312/257 R X |
| 3,745,735 | 7/1973 | Casano | 52/668 |
| 3,748,814 | 7/1973 | Cribben | 52/668 |
| 3,784,089 | 1/1974 | Koch | 232/24 |
| 3,797,192 | 3/1974 | DeJonge | 52/668 |

FOREIGN PATENT DOCUMENTS

| | | | |
|---|---|---|---|
| 2238355 | 2/1975 | France | 232/24 |

*Primary Examiner*—Roy D. Frazier
*Assistant Examiner*—Peter A. Aschenbrenner

[57] ABSTRACT

A door panel for covering the open side of a mail box having a series of individual mail receiving compartments, comprising: a peripheral frame and a grid structure consisting of interlocked horizontal and vertical channel members; a first interlocked channel member has an opening and slots defining a pair of oppositely disposed wall projecting portions while a second interlocked channel member has a pair of slots extending from the free edge of its walls to define oppositely disposed tongues; during assembly of the door panel, the tongues are deformingly bent inwardly in the channel of the first channel members to provide a positive interlock between both channel members.

7 Claims, 4 Drawing Figures

DOOR PANEL FOR MAIL BOX UNIT

FIELD OF THE INVENTION

The present invention relates to door panels and, more particularly, to a door panel for use in covering the open face of a mail box having a series of individual mail receiving and dispensing compartments.

BACKGROUND OF THE INVENTION

Until now, the grid structure and peripheral frame on which individual doors for mail compartments are hung have been made from either a solid metal plate, out of which openings have been cut leaving the appropriate grid structure, or solid extrusions, jointed and held together with fasteners to form the grid structure.

The disadvantages of grid structures made from solid metal plates are large scrap loss and expensive milling while those made of solid extrusions are the absolute requirement of solid extrusions and costly drilling and tapping operations.

OBJECTS AND STATEMENTS OF THE INVENTION

It is an object of the present invention to provide a door panel for a mail box which is simple in construction, inexpensive in costs and effective in preventing unauthorized access to the compartments of a mail box.

According to the invention, horizontal and vertical channel members are interlocked to form a grid structure; the channel members are provided with interengaging slots and openings which enable them to be fitted into one another; they are formed of a bendable material so that, once assembled, the channel members may be positively interlocked by deforming, through a bending operation, portions of one channel member into the channel of the other channel member.

The present invention therefore relates, in its broadest aspect, to a door panel which comprises in combination: a peripheral frame adapted to be hingedly mounted to the mail box; a grid structure consisting of interlocked horizontal and vertical channel members, each channel member including a pair of transversely spaced walls connected along one edge thereof by and integral with a web; a first of the interlocked channel members having at least one opening through the web thereof and a pair of slots longitudinally spaced in each of the walls and contiguous with the opening to define oppositely disposed wall projecting portions extending toward the opening; a second of the channel members interlocked with the first channel member including a pair of longitudinally spaced slots in each wall, the slots extending from the free edge of the wall to a distance which is less than the overall width of the wall to define a pair of oppositely disposed tongues, the tongues being deformingly bent inwardly in the channel of the first channel member thereby securing the first and second channel members together.

Other objects, purposes and characteristic features of the present invention will be in part obvious from the accompanying drawings, and in part pointed out as the description of the invention progresses. In describing the invention in details, reference will be made to the accompanying drawings, in which like reference characters designate corresponding parts throughout the several views.

DESCRIPTION OF PREFERRED EMBODIMENTS

Figure 1:
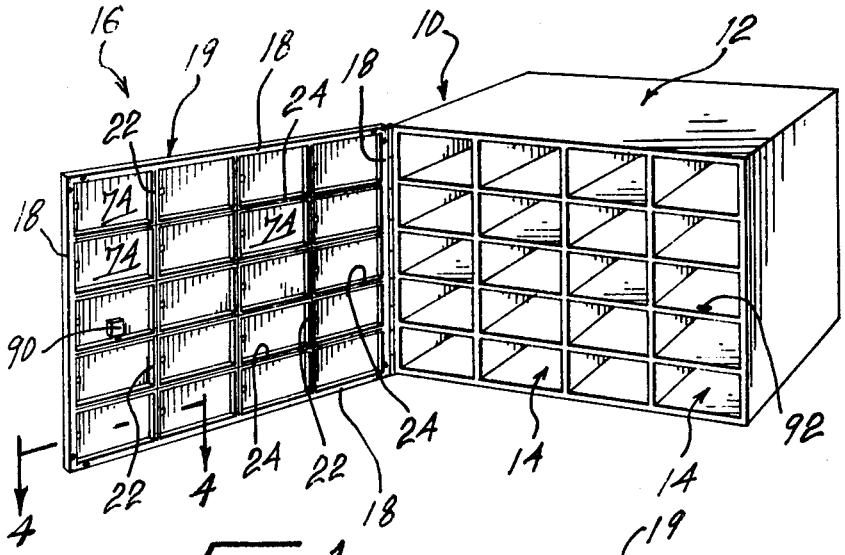
FIG. 1 is a perspective view showing a mail box equipped with a door panel made in accordance with the present invention.

Referring to FIG. 1, there is shown a mail box, generally designated 10, which consists principally of a housing 12 in which a series of horizontal and vertical partitions define a series of mail receiving and dispensing compartments 14. A mail box of this type may be installed, for example, in the wall opening of a post-office station or of an apartment building where individual mail compartments are allotted to different persons or firms. The structure of housing 12 will not be described in greater details since it does not form part of the present invention.

A door panel, generally denoted 16, is shown in FIG. 1, hingedly mounted to one side of the mail box. This door panel is of a size corresponding to that of the front open face of housing 12 so as to cover it entirely when closed. When opened, the door enables a postman, for example, to have access to all of the individual mail compartments at one time. The door panel 16 may be pivotally mounted to any of the vertical or horizontal side edges of the mail box; it may also be permanently fixed to the mail box in cases where mail feeding to the compartments is done from the rear of the box housing.

The door panel 16 has a peripheral frame 19 formed of a series of border elements 18 which are interconnected at their opposite ends by means of internal corner gussets 20 and set screws 21. In the embodiment illustrated, the frame is rectangular and border elements 18 are tubular with a square-shaped cross-section. A series of identically shaped vertical and horizontal U-shaped channel members 22 and 24 define the grid structure of the present invention, which structure is included within the peripheral frame 19.

Figure 3:
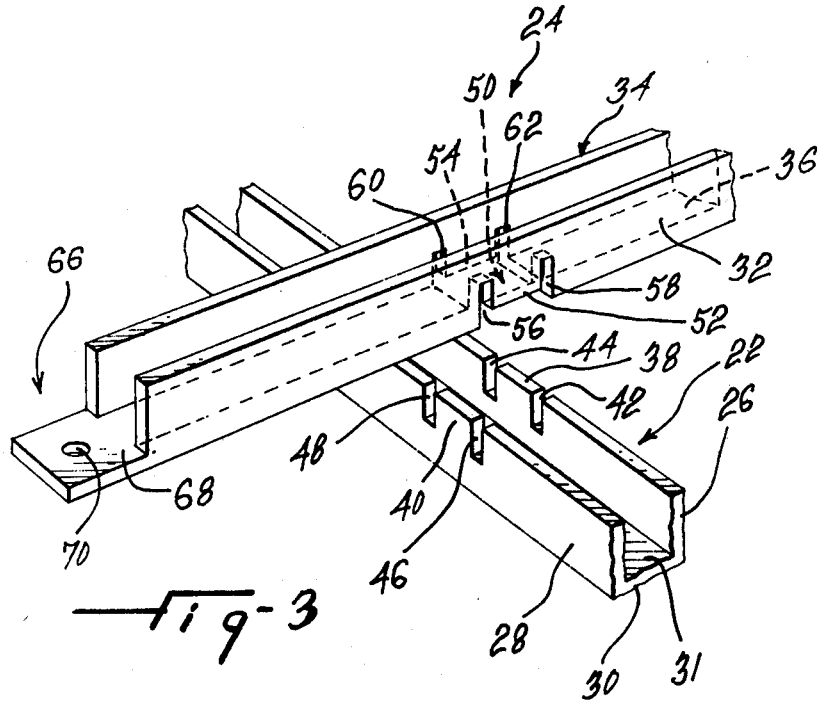
FIG. 3 is an exploded perspective view of the two interlocking channel members.
Figure 4:
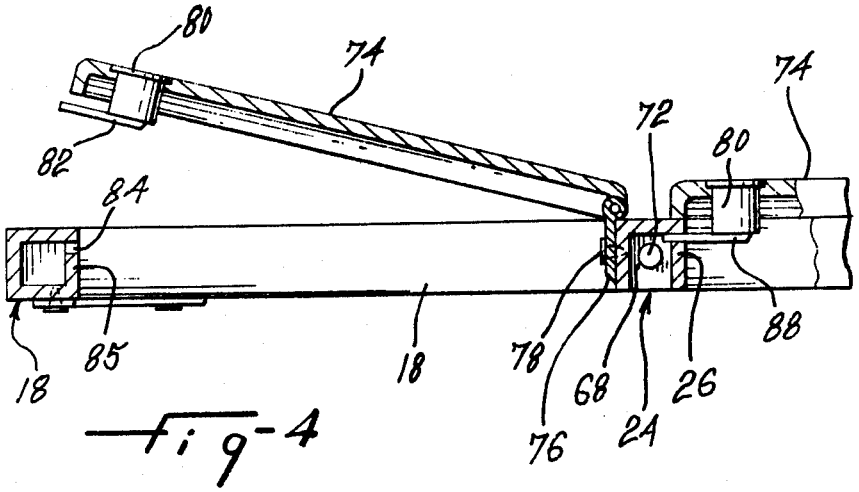
FIG. 4 is a cross-sectional view taken along lines 4—4 of FIG. 1.

Referring more particularly to FIG. 3, the vertical channel member 22 includes two side walls 26 and 28 which are connected along one edge thereof by and integral with a web 30. The horizontal channel member 24 also includes a pair of transversely spaced walls 32 and 34 which are connected along one edge by and integral with a web 36.

Each vertical channel member 22 includes a number of oppositely spaced tongues 38 and 40 which are defined by a series of slots 42 and 44, 46 and 48, respectively. These slots extend from the free edge of side walls 26 and 28 to a distance which is less than the distance separating the free edge of the walls to the inner face of web 30. The number of oppositely disposed tongues 38 and 40 in a channel member will, of course, depend upon the number of compartments in the mail box housing 12. Should there be only four compartments, only one horizontal member 24 and one vertical member 22 would be required with only one pair of tongues 38 and 40 in the vertical member.

Each horizontal channel member 24 includes a member of openings 50 in its web 36 and of oppositely disposed wall projections 52 and 54 defined by pairs of slots 56 and 58, 60 and 62, respectively. The plane that includes the free edge of wall projections 52 and 54 is offset inwardly in the channel with respect to the plane that includes web 36 such that, when members 22 and 24 are assembled, these free edges will rest on the inner face 31 of the web 30.

Figure 2:
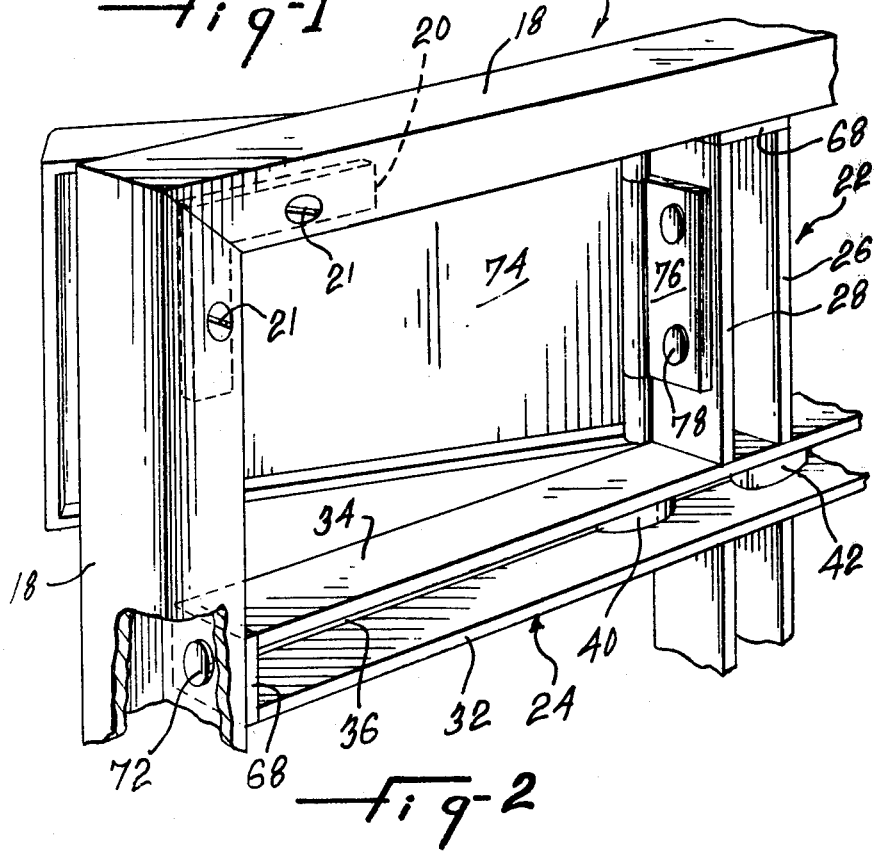
FIG. 2 is an enlarged perspective rear view of a corner section of the door panel shown in FIG. 1.

The engagement of channel member 22 with channel member 24 is carried out by bringing slots, 42, 44, 46, 48 of member 22 in registry with slots 58, 62, 56, 60, of member 24, respectively, and by assembling both members together whereby wall projections 52 and 54 bear against inner face 31 of web 30, and tongues 38 and 40 project outwardly in channel member 24. An important feature of the present invention is that a positively rigid grid structure is formed when tongues 38, 40, are deformed and bent inwardly in the channel of member 24 (see FIG. 2). This bending operation can be carried out by means of a brake device or by an air or hydraulic cylinder press; these operations are well known in the art of metal sheet forming and will not be described in detail. The grid structure thus formed is mounted to the peripheral frame 19 in the following manner. Each opposite extremity of channel members 22, 24 has a cutout portion 66 (one being shown in FIG. 3) which is formed by stamping out the extremity of the side walls and leaving a projecting web portion 68. A hole 70 is then bored or punched centrally of projecting portion 68 and the latter is deformed and bent upwardly to bear against the extremities of side walls (i.e. side walls 32 and 34 in FIG. 3). Referring to FIG. 2, a rivet 72 is punched through hole 70 to secure the channel member to the border elements 18.

Individual compartment doors 74 are mounted to the grid structure. In the embodiment illustrated in FIG. 2, door 74 is shown pivotally mounted to side wall 28 of a vertical channel member 22 by means of a bracket 76 which is riveted at 78 to the side wall. On each door 74, a lock 80 is provided with a locking cam 82 which is adapted to slide in a slot 84 provided either in the inner wall 85 of border elements 18 or in side wall 26 of a vertical channel member 22.

Second locking means 90 are further provided (see FIG. 1) on one of the doors 74 for locking the door panel 16 to the housing 12. A slot 92 or suitable member mounted in a corresponding compartment 14 allows the locking action of lock 90.

Various changes and modification may be brought to the present invention without departing from the scope thereof defined in the following claims. For example, the outer face of web portions 30 and 36 may be shaped differently to alter the front appearance of the door panel. It is therefore wished to have it understood that the present invention should not be limited in interpretation except by the terms of the following claims.

The embodiments of the invention in which an exclusive property or privilege is claimed are defined as follows:

1. A door panel for covering the open face of a mail box having a series of individual mail receiving compartments, comprising, in combination: a peripheral frame adapted to be hingedly mounted to said mail box; a grid structure consisting of interlocked horizontal and vertical channel members, each member comprising a pair of transversely spaced walls connected along one edge thereof by and integral with a web; a first of said interlocked channel members having at least one opening through the web thereof and a pair of slots longitudinally spaced in each of said walls and contiguous with said opening to define oppositely disposed wall projecting portions extending toward said opening; a second of said channel members interlocked with said first channel member having a pair of longitudinally spaced slots in each of the walls thereof, said slots extending from the free edge of said walls to a distance thereon less than the overall width of each said wall to define a pair of oppositely disposed tongues, said tongues being deformingly bent inwardly in the channel of said first channel member thereby securing said first and second channel members together.

2. A door panel as defined in claim 1, wherein said channel members have their opposite ends fixedly secured to said peripheral frame.

3. A door panel as defined in claim 2, wherein each opposite end of said channel members includes a web projection inwardly bent to abut the extremities of the side walls thereof; said web projection being fixedly mounted to said peripheral frame.

4. A door panel as defined in claim 1, wherein said interlocked channel members and said peripheral frame define a series of mail dispensing openings in registry with the compartments of said mail box when said door panel covers the open side of said mail box; a door in each said opening; first locking means associated with each said door for locking said door to said grid structure.

5. A door panel as defined in claim 4, further comprising second locking means mounted on said grid structure for locking said door panel to said mail box.

6. A door panel as defined in claim 1, wherein said grid structure consists of a plurality of said first and second channel members; each said first channel member including a series of said wall projecting portions longitudinally spaced on each said side wall thereof; each said second channel member including a series of said tongues longitudinally spaced on each said side wall thereof and located thereon to be received in corresponding openings in said first channel members.

7. A door panel as defined in claim 6, wherein said first and second channel members are identically shaped.

* * * * *